US005287611A

United States Patent [19]

Muselli

[11] Patent Number: 5,287,611

[45] Date of Patent: Feb. 22, 1994

[54] RIVETING ANVIL POSITIONING DEVICE WITH INTERCHANGEABLE ANVIL FOR RIVETING OPERATIONS PERFORMED BY AUTOMATIC MACHINE TOOLS

[75] Inventor: Roberto Muselli, Piacenza, Italy

[73] Assignee: JOBS S.p.A., Piacenza, Italy

[21] Appl. No.: 977,108

[22] Filed: Nov. 16, 1992

[30] Foreign Application Priority Data

Dec. 2, 1991 [IT] Italy ..... PC91-A-000017

[51] Int. Cl.[5] ..... B21J 15/22

[52] U.S. Cl. ..... 29/243.53

[58] Field of Search ..... 29/509, 243.517-243.55

[56] References Cited

U.S. PATENT DOCUMENTS 3,898,833 8/1975 Richardson ..... 29/243.525

4,312,107 1/1982 White ..... 29/243.53

FOREIGN PATENT DOCUMENTS 3715927 5/1987 Fed. Rep. of Germany ... 29/243.53

*Primary Examiner*—Robert C. Watson

*Attorney, Agent, or Firm*—Notaro & Michalos

[57] ABSTRACT

An anvil positioning device for an automatic machine tool which performs a rivet operation on a rivet comprises a chuck (3) movably connected to the machine tool (2). A block (17) is slidably mounted axially inside of the chuck. An interchangeable anvil (12) is engageable with the chuck and has a rod (20) which is slidably mounted within the anvil for pressing a rivet. A control unit (40) is used to control the movement of the chuck and a pressing unit (30) is used to press the block against the rod of the anvil.

5 Claims, 3 Drawing Sheets

RIVETING ANVIL POSITIONING DEVICE WITH INTERCHANGEABLE ANVIL FOR RIVETING OPERATIONS PERFORMED BY AUTOMATIC MACHINE TOOLS

FIELD AND BACKGROUND OF THE INVENTION

The present invention relates to an anvil positioning device with an interchangeable anvil for riveting operations performed by automatic machine tools.

In particular, it relates to a positioning device, designed to be fitted to a support with several degrees of freedom, which positions the anvil spatially.

The present invention relates to the field of automatic machine tools, and in particular to automatic machine tools which are used to assemble aircraft parts, e.g., to fit the skin of the aircraft onto the load-bearing structure of the aircraft. The difficulties encountered in performing these operations correctly and within the manufacturers' tolerances are well known.

Various tools are need to be brought to the the rivets which are positioned at right angles to the surface, whatever its inclination, and automatically perform the various operations required, such as drilling, flaring, adhesive spreading, rivet insertion, rivet driving, etc., while keeping within narrow positioning and orthogonality tolerances.

The equipment which is able perform these operations on various types of structures is already known; in particular, one such type of equipment is described in U.S. Pat. No. 5,004,064 held by the Applicant.

This reference relates to a machine tool comprising a support which moves along three cartesian axes, an operating head with two degrees of freedom fitted to the said support, and a plate with connection points for a positioning device, the plate is fitted to the operating head and able to perform controlled movements along a pair of cartesian axes.

These machines however, present some problems in the case where rivet insertion into the structures of rather complex shape, such as those shown in FIGS. 1*a*, 1*b*, 1*c*, 1*d* and to 1*e* which schematically illustrate some possible configurations of the internal ribbing of the structure to be assembled, each of which calls for a different anvil.

Normally, the hammer of the anvil which drives in the rivet works on the outside of the structure (i.e. on the side of the panel to be attached to ribbing or the like), while the anvil is placed against the rivet on the inside. The anvil, therefore needs to be inserted into structures of quite complex shape while always remaining perpendicular to the surface, and the anvil axis must pass through the rivet.

It is therefore necessary to replace the anvil whenever operations change over from one structure to another, so that the right tool can always be used.

Another problem is posed by the need to position the anvil at an angle around its own axis as operations move along the structure to be assembled which, as already mentioned, is generally curved in both directions and has ribs of various shapes.

This characteristic makes it difficult, if not practically impossible, to design a single anvil suitable for all jobs (or all of the different types of area to be worked on) which possesses the correct attributes of pressure bar, rivet crushing, robustness and ease of manufacture.

SUMMARY OF THE INVENTION

All of these problems of the known devices are solved by the positioning device according to the present invention, which is designed to be fitted to a support with several degrees of freedom such as the support disclosed by the above-mentioned US patent.

The positioning device, according to the present invention, comprises a chuck connected to a control systems which controls its angular position numerically and locks it into the required position, an anvil with a standard connector designed to be connected and locked onto the chuck, a block sliding inside the chuck which is subject to the action of a pressing unit such as elastic or pneumatic systems which are designed to press the block against the anvil, and a rod which slides inside the anvil, such that one side of the rod rests against the rivet while the other side of the rod comes to rest against the block.

BRIEF DESCRIPTION OF THE DRAWINGS

This invention will now be described in detail, by way or example but not of limitation, by reference to the annexed figures in which:

As shown in FIG. 2, the positioning device in accordance with the present invention comprises a body 1 fitted to a machine tool support 2 which presents a number of degrees of freedom, e.g. 5 or more.

Figure 1C:
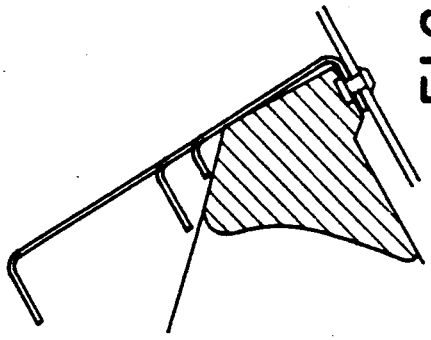
FIGS. 1*a*, 1*b*, 1*c*, 1*d*, and 1*e*, illustrate various parts to be riveted.
Figure 1E:
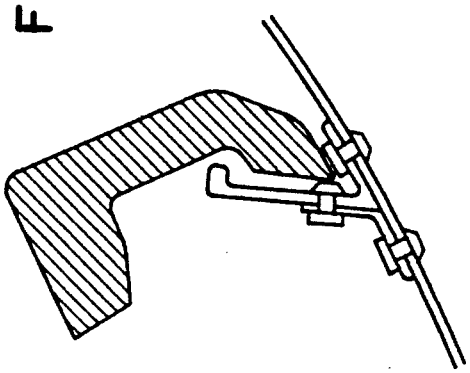
Figure 1B:
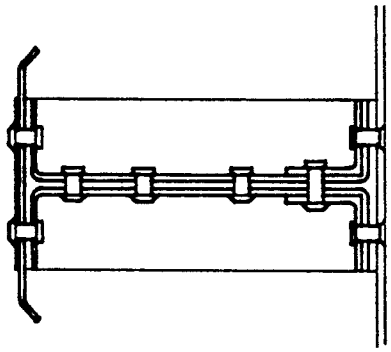
Figure 1D:
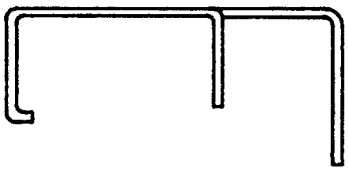
Figure 1A:
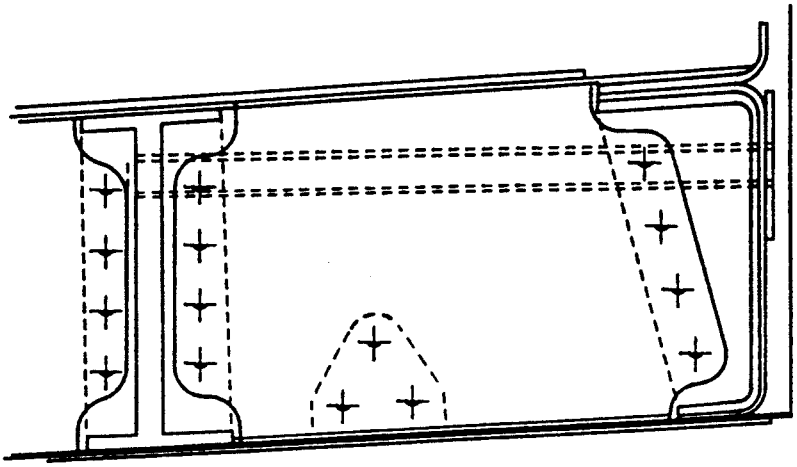

A hollow chuck 3 is fitted in body 1, and a cogwheel 4, which is activated via a belt 5 and by a motor 6, which is in the turn controlled by a controlling unit 40 which is an encoder, resolver or the like.

Motor 6 serves to give the chuck 3 the required angular position around its own axis.

A hydraulic brake 7 enables chuck 3 to be locked in rotation and traverse.

Chuck 3 is fitted to body 1 via a set of supports 9 and is subject to the action of the same number of springs 10 or the like which tend to move it away from body 1 within preset load and travel limits.

A limit microswitch or the like, not shown in the figure, is fitted to the chuck support 9 and connected to the machine control unit 40. The microswitch it is activated by chuck 3 when it approaches the workpiece and determines the correct axial position.

As a result, chuck 3 can perform limited axial traverse movements in relation to body 1, sliding on supports 9 while counteracting the elastic force of springs 10. A front part 8 of the chuck contains a housing 11 for A standard shank 13 of the anvil such as an anvil assembly 12 as in FIG. 2.

Anvil shank 13 presents an inclined ring-shaped surface or shoulder 14.

A number of pistons 15, inclined in relation to the anvil axis, are fitted to support 8. The piston rods 5 project inside the housing 11 in which the shank 13 is inserted, and press against shoulder 14 and lock the anvil 12 to support 8. The anvil is fitted with a key, lug bolt or the like which ensures its exact angular positioning in relation to the connector 8.

A set of pipes 16 conveys a pressurised fluid to pistons 15, and to chip blowing devices on the anvil 12 which will be described below.

A block 17 is connected to a movement detection unit 50, such as devices of a known type which detect its movements precisely, for example, through the use of a linear variable differential transformer, LVDT, and the block 17 is permitted to slide axially inside chuck 3. The detection unit 50 is connected to the control unit 40.

Block 17 is subject to the action of pressing unit 30 such as elastic or pneumatic systems which tend to keep it pressed against the anvil shank 13 with controlled force when the anvil 12 is fitted to chuck portion 8. The pressing unit 30 is controlled by controlling unit 40.

Figure 2:
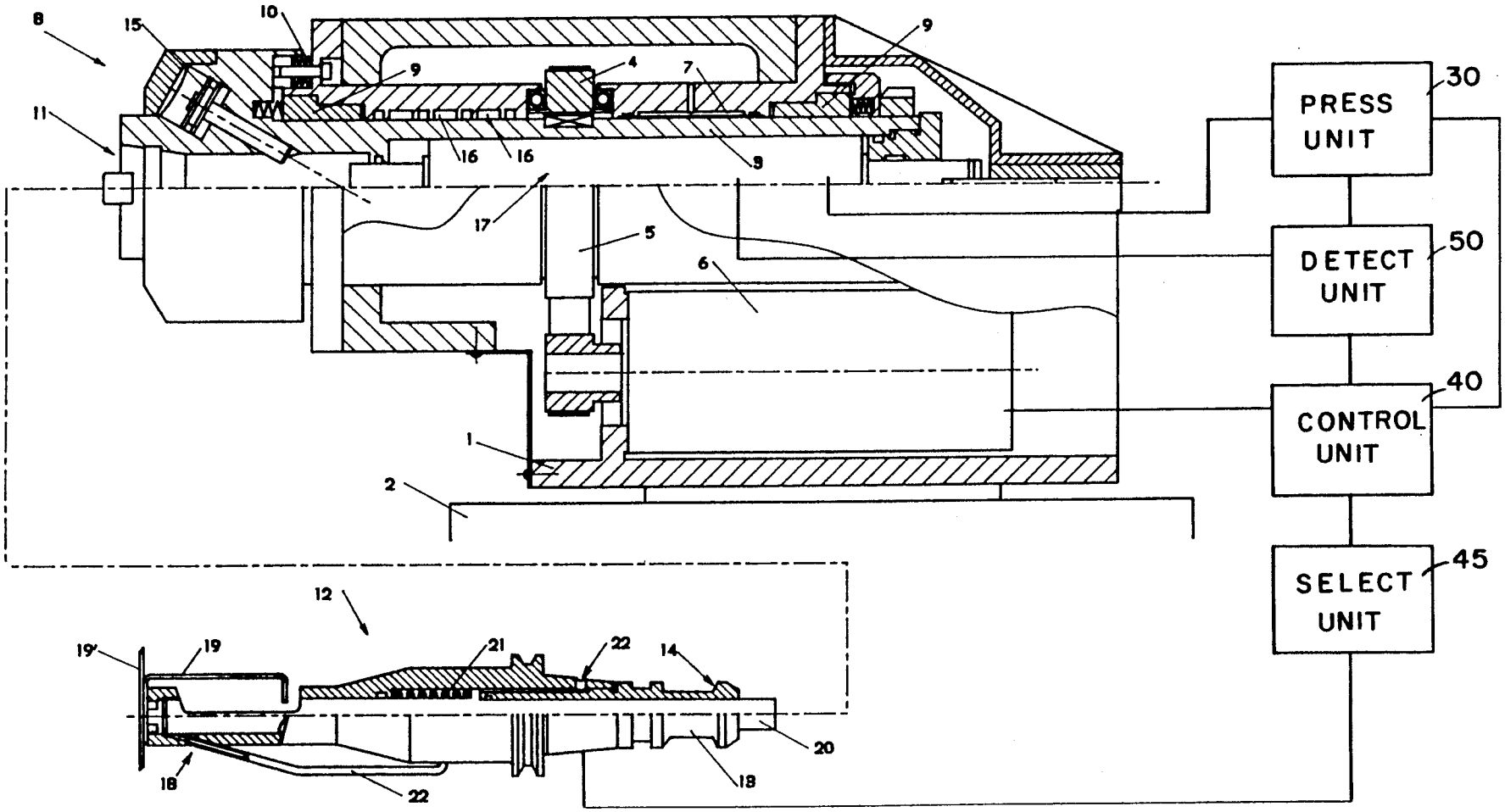
FIG. 2 is a cross-section of the positioning device in accordance with the present invention and having the anvil removed.
Figure 3:
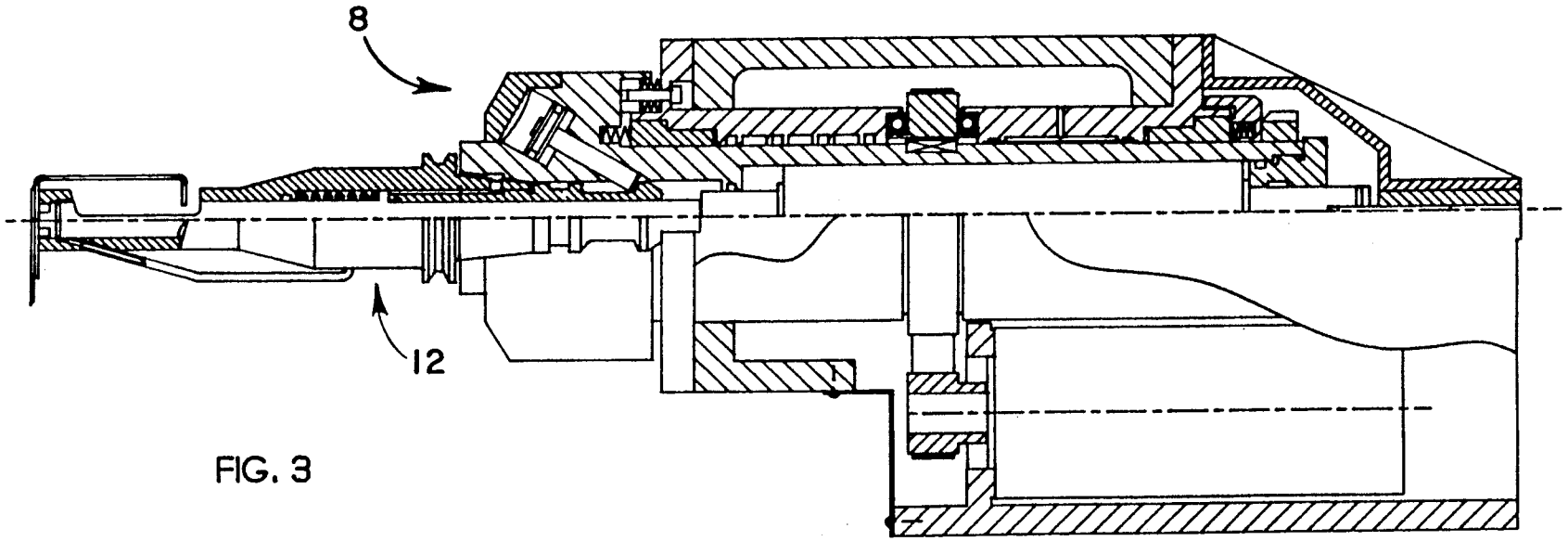
FIG. 3 is a view in cross-section of the positioning device of FIG. 2 with the anvil fitted.

A front part 18 of anvil 12 as shown in FIG. 2 is shaped so that it can be placed against the structures to be assembled 19 and 19' and kept perpendicular to the surface.

A rod 20 slides inside anvil 12, which is hollow. The rod 20 is subject to the action of a spring 21 which tends to push it backwards, with the end of the rod 20 which projects from the shank 13 coming to rest against block 17. Some chip outlets are located at the end of the tip. The chips are blown out by pressurised air conveyed from a pipe 22 which is supplied, when the anvil 12 is fitted, by one of the pipes 16 situated on the positioning device.

The machine 2 through the use of an anvil selector unit 45 connected with the control unit 40, the selector 45 automatically picks up the right anvil 12 for the movable rod 20 in the anvil 12, which transmits the job to be performed from a tool store and inserts it into support 8 of the chuck 3, in relation to which the anvil 12 takes up a known angular position due to the use of a key or the like with a corresponding seating in the connector 8. Pressurised air is then conveyed to pistons 15 whose rods come to rest against shoulder 14 of the anvil shank 13, keeping the anvil firmly locked to the positioning device.

At this point the numerical control 40 of the machine 2 brings the device into position, placing it with the anvil 12 perpendicular to the work point, after which it is advanced until the tip 18 of the anvil 12 rests against parts to be assembled 19.

The machine 2 continues to advance while chuck 3 recoils from the positioning device 40, counteracting the action exerted by springs 10, until it activates a limit microswitch or the like.

At this point the device is precisely positioned at the point to be worked on, pressing against the parts to be assembled with a pre-determined force produced by the calibration of springs 10.

The machine, operating on the outside, performs all the operations assigned to it and inserts the rivet into its seating.

Pressurised air is then conveyed to block 17 which advances, coming to rest against the projecting part of rod 20 which is pushed forwards, overcoming the resistance of spring 21, until it is positioned against the rivet tip. At this point the riveting hammer can be activated from the opposite side.

Kinetic energy will be absorbed by the rivet and partly transmitted to rod 20 and from there to block 17, which is kept in position by pneumatic systems 14 against the rivet tip which gradually buckles.

As the rivet is crushed, block 17 advances further and further from the body of the positioning device, and these movements are detected by the LVDT 50.

The advance of block 17 is proportional to the buckling of the rivet, so that when a preset point is reached, the machine stops and moves on to the next rivet.

Whenever a different structure needs to be riveted pistons 15 are retracted and the machine through its anvil selector 40 automatically replaces the anvil 12 with one suitable for the new job. The characteristic feature of the invention is therefore that it relates to a positioning device comprising (i) a chuck 3 connected to control systems 40, 5, 6 able to control its angular and axial position and fitted with a connector 8 for an interchangeable anvil 12 and (ii) an axially sliding block 17 inside the chuck 3 which is subject to the action of elastic systems 30 that keep it pressed against the movable rod 20 in the anvil 12, which transmits kinetic energy from the rivet to the moving block 17.

I claim:

1. An anvil positioning device for an automatic machine tool which performs a rivet operation on a rivet, the device comprising:

a chuck (3) movably connected to the machine tool (2);

control means (40) for controlling the movement of the chuck (3);

a block (17) slidably mounted axially inside of the chuck (3);

an interchangeable anvil (12) engageable with the chuck (3), the anvil having a rod (20) slidably mounted within the anvil for pressing a rivet; and pressing means (30) for pressing the block against the rod (20) of the anvil (12).

2. The anvil positioning device according to claim 1, including anvil selection means (45) for automatically selecting an interchangeable anvil.

3. The anvil positioning device according to claim 1, wherein the chuck (3) includes an anvil connector (3) for receiving the interchangeable anvil (12).

4. The anvil positioning device according to claim 1, including block detection means (50) for detecting the movement of the block.

5. The anvil positioning device according to claim 4, wherein the block detection means (50) comprises a linear variable differential transformer, LVDT.

* * * * *